US007160056B1

(12) United States Patent
Hoffmann et al.

(10) Patent No.: US 7,160,056 B1
(45) Date of Patent: Jan. 9, 2007

(54) MATERIAL TRANSFER VEHICLE FOR USE IN ASPHALT PAVING

(75) Inventors: John E. Hoffmann, Signal Mountain, TN (US); David Swearingen, Ooltewah, TN (US)

(73) Assignee: Roadtee, Inc., Chattanooga, TN (US)

( * ) Notice: Subject to any disclaimer, the term of this patent is extended or adjusted under 35 U.S.C. 154(b) by 0 days.

(21) Appl. No.: 11/372,725

(22) Filed: Mar. 10, 2006

Related U.S. Application Data

(60) Provisional application No. 60/660,618, filed on Mar. 11, 2005.

(51) Int. Cl.
*E01C 19/18* (2006.01)

(52) U.S. Cl. ..... 404/109; 404/108; 404/110

(58) Field of Classification Search ..... 404/108, 404/109, 110
See application file for complete search history.

(56) References Cited

U.S. PATENT DOCUMENTS

| | | | | |
|---|---|---|---|---|
| 4,944,630 A | | 7/1990 | Brock et al. | |
| 5,015,120 A | | 5/1991 | Brock et al. | |
| 5,035,534 A | | 7/1991 | Brock et al. | |
| 5,178,253 A | * | 1/1993 | Fix | 198/317 |
| 5,190,398 A | | 3/1993 | Swisher, Jr. | |
| 5,259,717 A | | 11/1993 | May | |
| 5,263,790 A | * | 11/1993 | Bickley et al. | 404/107 |
| 5,553,968 A | * | 9/1996 | Campbell | 404/108 |
| 5,642,961 A | * | 7/1997 | Campbell | 404/81 |
| 5,819,950 A | * | 10/1998 | McCloskey | 209/241 |
| 6,332,736 B1 | * | 12/2001 | Cape et al. | 404/75 |

FOREIGN PATENT DOCUMENTS

JP 2000-170118 * 6/2000

OTHER PUBLICATIONS

ROADTEC—SB-2500C Specifications; brochure; 2003; Chattanooga, Tennessee.
Roadtec—Full Line; catalog; 2000; Chattanooga, Tennessee.

* cited by examiner

*Primary Examiner*—Gary S. Hartmann
(74) *Attorney, Agent, or Firm*—Chambliss, Bahner & Stophel,P.C.

(57) ABSTRACT

A material transfer vehicle for transporting asphalt from a delivery truck to a paving machine includes a frame and a vehicle drive system. The vehicle also includes a turret that is rotatably mounted on the frame and a surge bin that is mounted on the turret. The surge bin has a front side and a rear side with a discharge opening therein. A truck-unloading conveyor is mounted on the frame. The truck-unloading conveyor has an inlet end, and an outlet end which is adjacent to the front side of the surge bin. A paver-loading conveyor is mounted on the turret and has an inlet end extending into the discharge opening on the rear side of the surge bin.

20 Claims, 16 Drawing Sheets

FIGURE 18
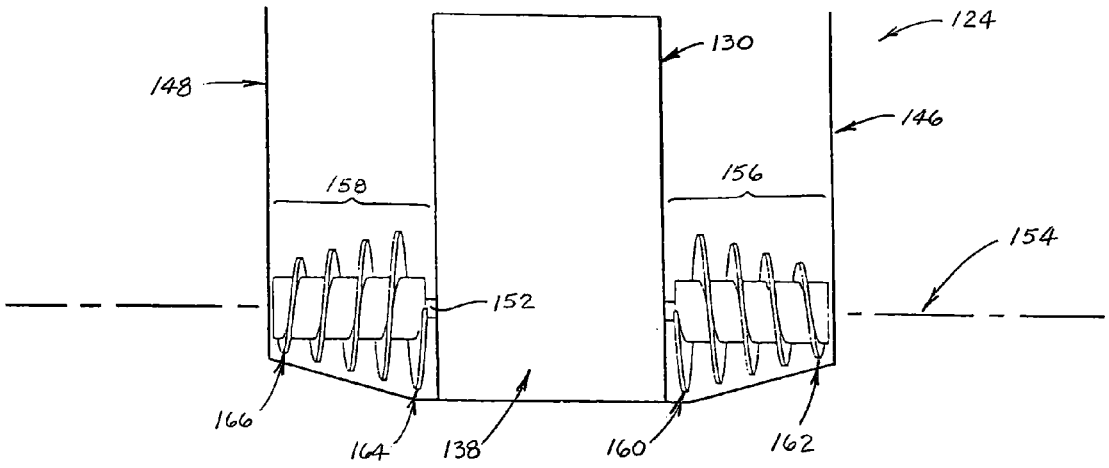
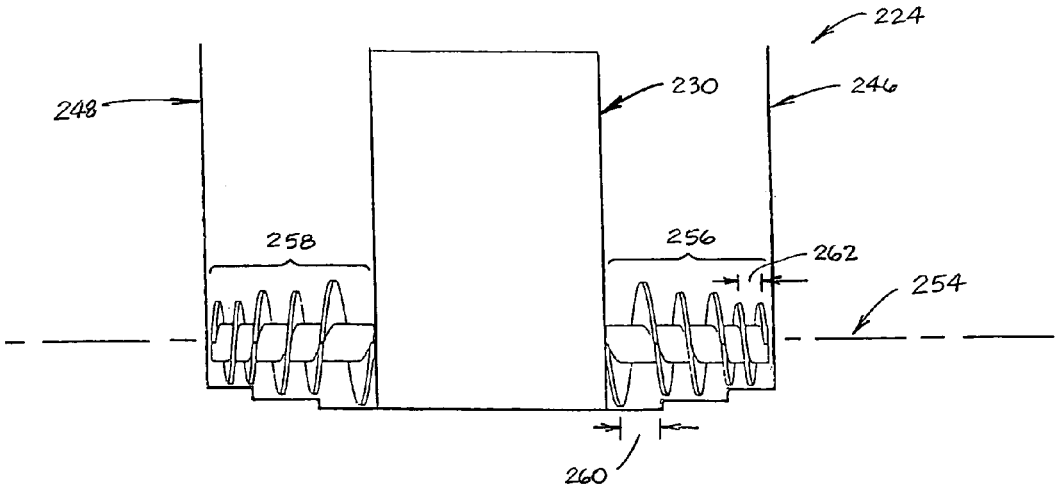
FIGURE 19

MATERIAL TRANSFER VEHICLE FOR USE IN ASPHALT PAVING

CROSS REFERENCE TO RELATED APPLICATION

This application claims the benefit of provisional Application No. 60/660,618, which was filed on Mar. 11, 2005.

FIELD OF THE INVENTION

The present invention relates generally to a self-propelled vehicle that is adapted for transferring asphalt from a supply truck to an asphalt paving machine.

BACKGROUND OF THE INVENTION

Paving of roadways with asphalt is generally carried out by an asphalt paving machine and a number of supply trucks which transport the asphalt from an asphalt production plant to the paving machine. The paving machine generally is self-propelled and driven by a wheeled or tracked drive system. A hopper is located at the front end of the machine to receive asphalt from a truck, and a floating screed is located at the rear end of the machine to form the asphalt mat. A conveyor system typically comprised of slat conveyors and screw augers delivers the asphalt from the hopper to the road base just ahead of the screed.

A typical asphalt paving machine has a hopper with a capacity of 5–15 tons, whereas a typical dump-type delivery truck has a capacity of about 20 tons. The front of the paving machine is usually provided with rollers which are adapted to engage the rear tires of a delivery truck. This arrangement enables asphalt to be transferred from the truck to the asphalt paving machine by positioning the delivery truck in front of the paving machine and raising the dump bed of the truck to dump the asphalt into the hopper as the paving machine pushes the truck along in front of it. Because the delivery truck usually carries more asphalt than the hopper can receive at one time, the paving machine may push the delivery truck along for several minutes while its conveyor system transports the asphalt out of the hopper to the roadway in front of the screed.

Sometimes, problems may arise when operating the paving machine and the delivery trucks in this manner. Because of traffic conditions and other unforeseen delays, it is not uncommon for the paving machine to empty its hopper of asphalt before a loaded delivery truck is available to begin dumping its asphalt into the hopper. When this occurs, the paving machine must stop paving and await the arrival of another delivery truck. Even if one or more loaded delivery trucks are available to dump asphalt into the paving machine hopper, it may be necessary to stop the paving machine. Sometimes, it is simply impossible for the truck drivers to remove an empty delivery truck from engagement with the front of the paving machine and to maneuver a loaded truck into position to dump into the hopper before the hopper is emptied.

As is known to those having ordinary skill in the art to which the invention relates, when a paving machine stops, even for a short time, the screed will tend to settle into the freshly laid asphalt mat. Then, when the paving machine resumes its forward motion, the screed will tend to ride upwardly momentarily, thus depositing an excessive amount of material. Consequently, stopping of the paving machine causes a depression and a bump in the surface of the asphalt mat, resulting in an uneven pavement surface. Consequently, in recent years, material transfer vehicles have been employed to shuttle asphalt between the delivery trucks and the paving machine. Such a material transfer vehicle is described in various embodiments in U.S. Pat. No. 4,818,139, U.S. Pat. No. 5,015,120 and U.S. Pat. No. 5,035,534, which are incorporated herein by reference. These patents describe a self-propelled material transfer vehicle which includes a large-capacity truck-receiving hopper and a large-capacity truck-unloading conveyor extending from this hopper to a surge bin that is sized to hold the entire load of a delivery truck. A conveyor in the surge bin is adapted to transfer asphalt to a paver-loading conveyor that is pivotable about an essentially vertical axis so that the transfer vehicle can be positioned alongside an asphalt paving machine that is laying an asphalt mat and rapidly discharge a truckload of asphalt into the paver's hopper. Because of its rapid loading and unloading capabilities, the material transfer vehicle can rapidly shuttle between delivery trucks at a pick-up point and a paving machine that is laying an asphalt mat so that there is less likelihood that the paving machine will have to stop paving because of a lack of asphalt.

Although this material transfer vehicle has met with much commercial success, it would be desirable if its weight could be reduced, and if other advantageous features could be incorporated into an improved material transfer vehicle.

ADVANTAGES OF THE INVENTION

Among the advantages of the invention is that it provides a material transfer vehicle which does not require three conveyors as does the prior art vehicle. Consequently, the improved vehicle of the invention is somewhat less complex and may have a significantly reduced weight. An advantage of a preferred embodiment of the invention is that it provides a four-wheeled material transfer vehicle in which both front and rear wheels are steerable for improved maneuverability. Another advantage of a preferred embodiment of the invention is that it provides such a vehicle with improved asphalt remixing capability in the surge bin.

Other advantages and features of this invention will become apparent from an examination of the drawings and the ensuing description.

EXPLANATION OF TECHNICAL TERMS

As used herein, the term "aggregate materials" refers to crushed stone and other particulate materials that are used in the production of asphalt, such as, for example, crushed limestone and other types of crushed stone, crushed or comminuted recycled asphalt paving materials, crushed, shredded or comminuted shingles and other asphalt binder-containing products, shredded or comminuted mineral and cellulosic fibers, gravel, sand, lime and other particulate additives.

As used herein, the term "asphalt binder" refers to a dark brown to black solid or semi-solid cementious material which gradually liquefies when heated, in which the predominating constituents are bitumens, all of which occur in the solid or semi-solid form in nature or are obtained by refining petroleum, which is used in the production of asphalt.

As used herein, the term "asphalt" refers to a bituminous paving mixture that is comprised of asphalt binder and any of various aggregate materials, and which is used for paving purposes.

As used herein, the terms "asphalt paving machine", "paving machine", "paver" and similar terms refer to a finishing machine for applying asphalt to form an asphalt mat on a roadway, parking lot or similar surface. An asphalt paving machine is typically a self-propelled vehicle having a hopper at one end for receiving asphalt and a screed at the other end for forming an asphalt mat.

As used herein, the term "asphalt mat" refers to a layer of asphalt such as is applied by an asphalt paving machine to produce a roadway, parking lot or similar surface.

As used herein, the terms "delivery truck", "truck" and similar terms refer to a vehicle for transporting asphalt along a roadway, which vehicle is adapted to transfer asphalt to a hopper that is mounted on a material transfer vehicle or a paving machine.

As used herein, the terms "forward", "front" and similar terms, when used in connection with a material transfer vehicle, a component of such vehicle or a position on such a vehicle, refer to the end of the machine nearest the truck-receiving hopper. The terms "backward", "rear" and similar terms, when used in connection with such a vehicle, component or position, refer to the end of the vehicle opposite the front end.

As used herein, the term "rotary actuator" and similar terms refers to an electric, hydraulic or electro-hydraulic device that generates force that is directed along an arc.

As used herein, the term "linear actuator" and similar terms refers to an electric, hydraulic or electro-hydraulic device that generates force that is directed in a straight line. One common example of a linear actuator is a hydraulic cylinder which includes a cylinder, a piston within the cylinder, and a rod attached to the piston. By increasing the pressure within the cylinder on one side of the piston (over that on the opposite side of the piston), the rod will extend from the cylinder or retract into the cylinder.

As used herein, the term "actuator" and similar terms refers to a rotary actuator and/or a linear actuator.

SUMMARY OF THE INVENTION

The invention comprises a material transfer vehicle for transporting asphalt from a delivery truck to a paving machine. This vehicle includes a frame and a vehicle drive system which is operatively attached to the frame and adapted to drive the vehicle. A turret is rotatably mounted on the frame, and a surge bin, which is adapted to contain a quantity of asphalt, is mounted on the turret. The surge bin has a front side and a rear side with a discharge opening in the rear side. The vehicle also includes a truck-unloading conveyor that is mounted on the frame. The truck-unloading conveyor has an inlet end and an outlet end which is adjacent to the front side of the surge bin. The truck-unloading conveyor is adapted to move asphalt from the inlet end to the discharge end. The vehicle also includes a paver-loading conveyor that is mounted on the turret. The paver-loading conveyor has an inlet end extending into the discharge opening on the rear side of the surge bin, and an outlet end, and it is adapted to move asphalt from the inlet end to the outlet end. In a preferred embodiment of the invention, the material transfer vehicle has a frame supported by at least four steerable wheels. In this embodiment of the invention, three steering modes are provided: (1) front wheel steering; (2) coordinated front and rear wheel steering for obtaining a shorter turning radius; and (3) coordinated front and rear wheel steering for obtaining sideways, or "crab" motion. The preferred embodiment also includes a forward-mounted operator station and a rear-view camera mounted on the underside of the paver-loading conveyor. The preferred embodiment also includes a transverse mixing auger in the surge bin having auger blades with varied pitch and/or diameter. The preferred embodiment of the invention also includes a paver-loading conveyor that is adapted pivot between a lowered position and a raised position that is about 25° above the horizontal.

In order to facilitate an understanding of the invention, the preferred embodiments of the invention are illustrated in the drawings, and a detailed description thereof follows. It is not intended, however, that the invention be limited to the particular embodiments described or illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which:

FIG. 18 is a partial sectional view through the surge bin of the embodiment of FIGS. 4–17, taken through line 18—18 of FIG. 5, showing a preferred embodiment of the transverse mixing auger in the surge bin.

FIG. 19 is a partial sectional view through a surge bin similar to that of FIG. 18, showing an alternative embodiment of the transverse mixing auger in the surge bin.

DESCRIPTION OF THE PREFERRED EMBODIMENTS OF THE INVENTION

Figure 1:
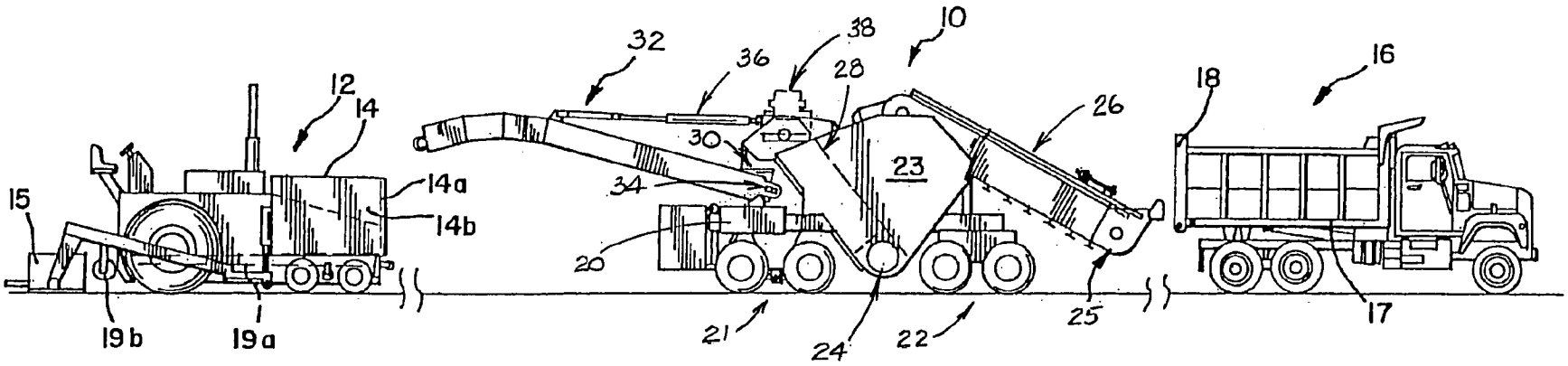
FIGURE 1 PRIOR ART
FIG. 1 is a side view of a conventional material transfer vehicle in association with an asphalt delivery truck and an asphalt paving machine.

FIG. 1 shows self-propelled material transfer vehicle 10 which is described in U.S. Pat. No. 4,818,139, U.S. Pat. No. 5,015,120 and U.S. Pat. No. 5,035,534 in association with asphalt paving machine 12 and conventional delivery truck 16. Paving machine 12 includes hopper 14 which has been expanded by providing front wall 14*a* and side walls 14*b* of increased height. Paving machine 12 also includes vibratory screed 15 and conventional conveyor system comprising longitudinally disposed conveyors 19*a* and transversely disposed screw auger 19*b* for delivering the asphalt from hopper 14 to a position just in advance of screed 15 where it is discharged onto the surface to be paved. Conventional delivery truck 16 includes a pivotally mounted bed 17 with a tailgate 18, and is adapted to deliver asphalt from a remote source to material transport vehicle 10.

Vehicle 10 includes frame 20 that is supported on the roadway surface by first wheel set 21 and second wheel set 22. Each of the wheel sets is driven by a hydraulic motor (not shown) that is supplied with fluid under pressure by one or more hydraulic pumps (also not shown). An engine (also not shown) provides the motive force for the hydraulic pumps. Vehicle 10 includes surge bin 23 that is mounted on frame 20 and includes transverse auger 24 that is employed to mix the asphalt in the surge bin in order to minimize segregation or separation of the aggregate portion of the asphalt by size. Vehicle 10 also includes truck-receiving hopper 25 and truck-unloading conveyor 26 for receiving asphalt from delivery truck 16 and conveying it to the surge bin. Hopper 25 is generally of the same width as truck bed 17 and is adjustable in length so that the contents of truck 16 can be easily and quickly emptied into the hopper. Conveyor 26 is of the drag-slat type and is adapted to quickly convey an entire truckload of asphalt into surge bin 23. Drag-slat type discharge conveyor 28 is located along the sloped side of surge bin 23 opposite truck-unloading conveyor 26 and is adapted to convey asphalt out of the surge bin to chute 30 which is associated with paver-loading conveyor 32. Asphalt conveyed out of the surge bin by conveyor 28 falls through chute 30 and onto paver-loading conveyor 32. Paver-loading conveyor 32 is of the belt-type and is mounted for vertical pivotal movement about pivot 34 as raised and lowered by hydraulic lift cylinder 36. Conveyor 32 is also adapted for side-to-side movement about a vertical axis (not shown) that extends through hopper 30 by operation of another hydraulic cylinder (also not shown). Vehicle 10 is operated by an operator located at operator station 38.

Figure 3:
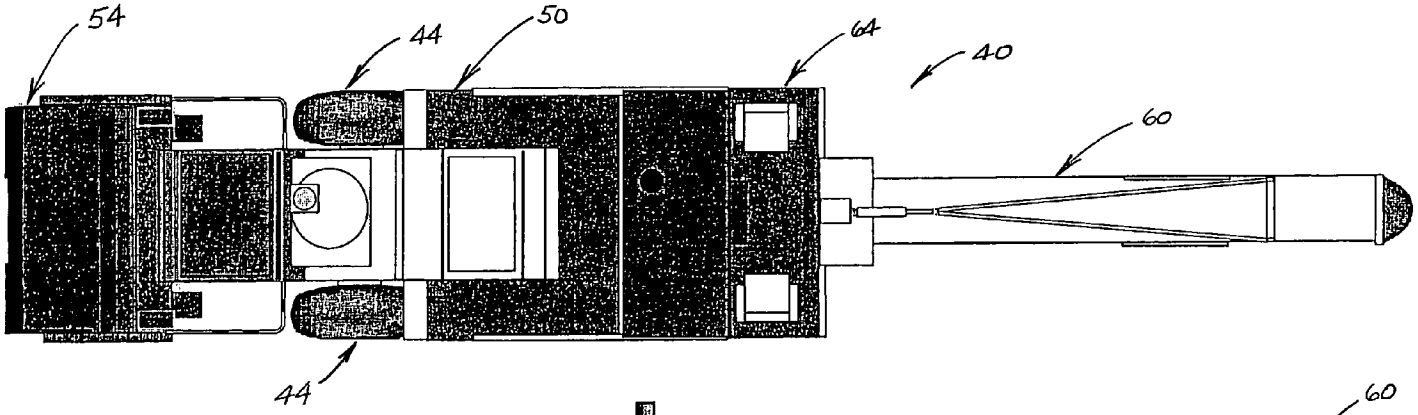
FIGURE 3 PRIOR ART
FIG. 3 is a top view of the vehicle of FIG. 2.
Figure 2:
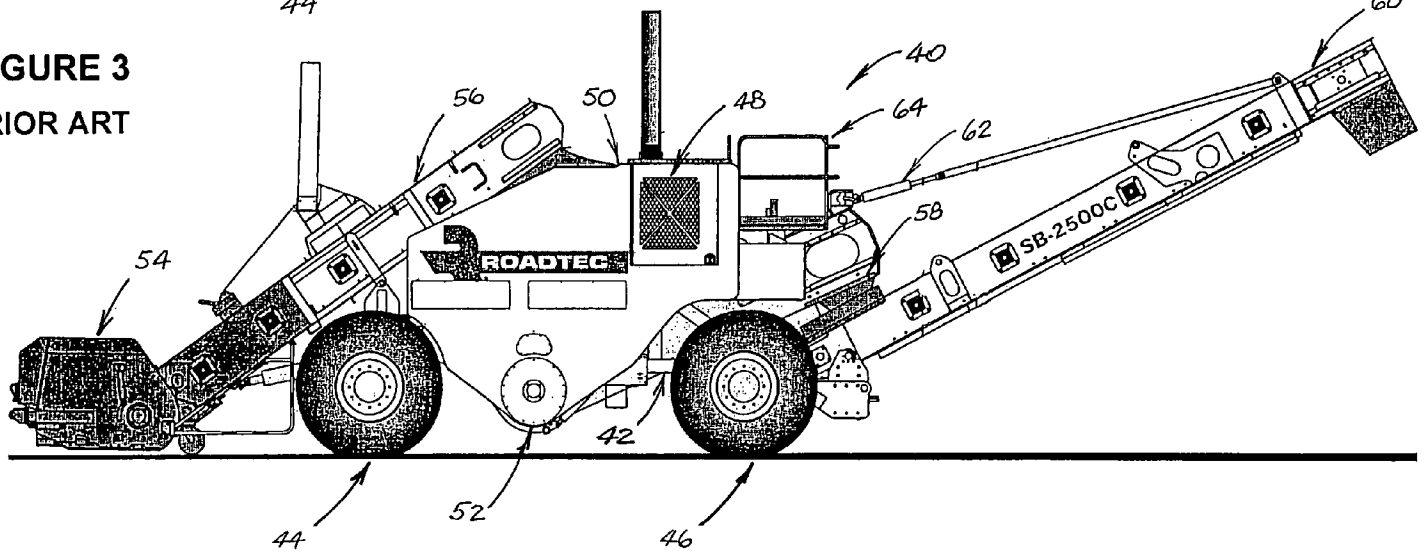
FIGURE 2 PRIOR ART
FIG. 2 is a side view of another conventional material transfer vehicle.

A modified version of vehicle 10 is illustrated in FIGS. 2 and 3. As shown therein, vehicle 40 includes frame 42 that is supported on the roadway surface by first wheel set 44 and second wheel set 46. Each wheel of a wheel set is connected to an axle that is driven by a hydraulic motor (not shown) which is supplied with fluid under pressure by one or more hydraulic pumps (also not shown). An engine (located behind grate 48) provides the motive force for the hydraulic pumps. Vehicle 40 includes surge bin 50 that is mounted on the frame and includes transverse auger 52 that is employed to mix the asphalt in the surge bin in order to minimize segregation or separation of the aggregate portion of the asphalt by size. Vehicle 40 also includes truck-receiving hopper 54 and truck-unloading conveyor 56 for receiving asphalt from a delivery truck such as truck 16 and conveying it to the surge bin. Hopper 54 is generally of the same width as truck bed 17 and is adjustable in length so that the contents of truck 16 can be easily and quickly emptied into the hopper. Conveyor 56 is of the drag-slat type and is adapted to quickly convey an entire truckload of asphalt into surge bin 50. Another drag-slat type discharge conveyor (not shown, but similar to conveyor 28 of vehicle 10) is located along the sloped side of surge bin 50 opposite truck-unloading conveyor 56 and is adapted to convey asphalt out of the surge bin to chute 58 which is associated with paver-loading conveyor 60. Asphalt conveyed out of the surge bin by the surge bin conveyor falls through chute 58 and onto paver-loading conveyor 60. Paver-loading conveyor 60 is of the belt-type and is mounted for vertical pivotal movement as raised and lowered by hydraulic lift cylinder 62. Conveyor 60 is also adapted for side-to-side movement about a vertical axis by operation of another hydraulic cylinder (also not shown). Vehicle 40 is operated by an operator located at operator station 64.

A first embodiment of the invention is illustrated in FIGS. 4–18 and 20–22. As shown in FIGS. 4–17, self-propelled material transport vehicle 100 includes frame 102 having a front end at 104 and a rear end at 106. Vehicle 100 includes a vehicle drive system which is operatively attached to frame 102 and adapted to drive the vehicle along a roadway surface. As shown in FIGS. 4–17, the vehicle drive system includes a front wheel set comprised of left front wheel 108 and right front wheel 109 and a rear wheel set comprised of left rear wheel 110 and right rear wheel 111. Preferably, as illustrated in the drawings, each wheel set is comprised of a pair of wheels with pneumatic tires; however, other wheel sets such as are known to those having ordinary skill in the art to which the invention relates may alternatively be used. Each wheel of a wheel set is connected to an axle that is driven by a hydraulic motor (not shown) which is supplied with fluid under pressure by one or more hydraulic pumps (also not shown). This hydrostatic drive system is similar to the hydrostatic drive systems of vehicles 10 and 40. An engine (located in compartment 112) provides the motive force for the hydraulic pumps. In this embodiment of the invention (as described in more detail hereinafter), three steering modes are provided: (a) front wheel steering where front wheels 108 and 109 are steerable in the manner of an automobile and rear wheels 110 and 111 are set to roll in a line that is parallel to longitudinal frame axis 114 of the vehicle; (b) coordinated front and rear wheel steering to pivot the vehicle such as for example, by turning the front wheels to the right and simultaneously turning the rear wheels to the left to reduce the turning radius of the vehicle; and (c) coordinated front and rear wheel steering to move the vehicle in a non-pivoting manner, i.e. "crabwise", by turning both the front and the rear wheels in the same direction to move the vehicle along a line that is not parallel to frame axis 114.

It is also preferred that the hydrostatic drive system of vehicle 100 permit differential fluid flow between the front and rear drive subsystems, and that it can be set or "locked" to provide equal flow to the front and rear drive subsystems to improve vehicle stability on loose or muddy terrain. Such a vehicle drive system may include a valve arrangement in the hydraulic fluid lines to the hydraulic motors to permit flow of hydraulic fluid at the same rate to the front and rear hydraulic motors or to permit differential flow of hydraulic fluid (i.e. at a different rate) to the front and rear hydraulic motors, as selected by the operator.

The preferred embodiment of vehicle 100 also includes truck-unloading conveyor 116 having inlet end 118 and outlet end 120. Truck receiving hopper 122 is mounted on the inlet end of truck-unloading conveyor for receiving asphalt from a delivery truck such as truck 16. Hopper 122 is generally of the same width as truck bed 17 and is adjustable in length so that the contents of a delivery truck can be easily and quickly emptied into the hopper. Conveyor 116 is preferably of the drag-slat type and is adapted to quickly convey an entire truckload of asphalt from the inlet end to the outlet end and into surge bin 124. Surge bin 124 is adapted to contain a quantity of asphalt and has a front side 126 and a rear side 128. Rear side 128 of surge bin 124 has a discharge opening to receive the inlet end of paver-loading conveyor 130.

Figure 4:
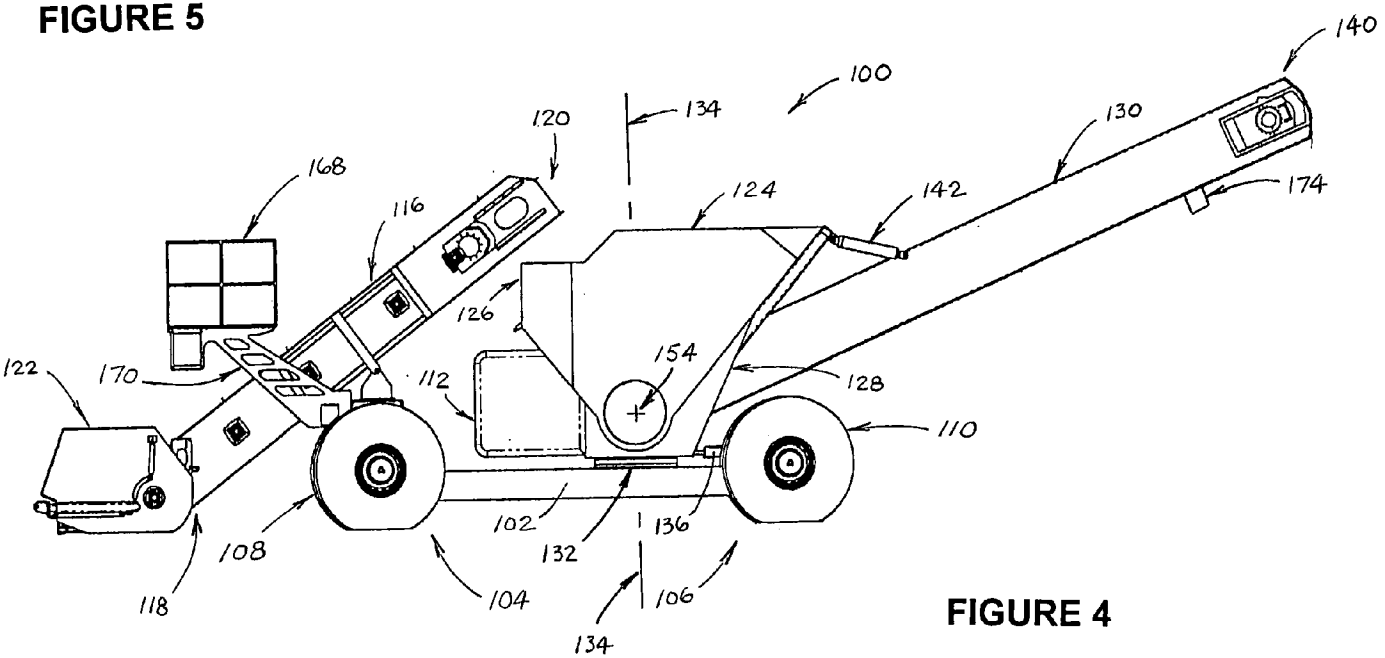
FIG. 4 is a side view of a first embodiment of the invention showing the paver-loading conveyor in an elevated position.
Figure 8:
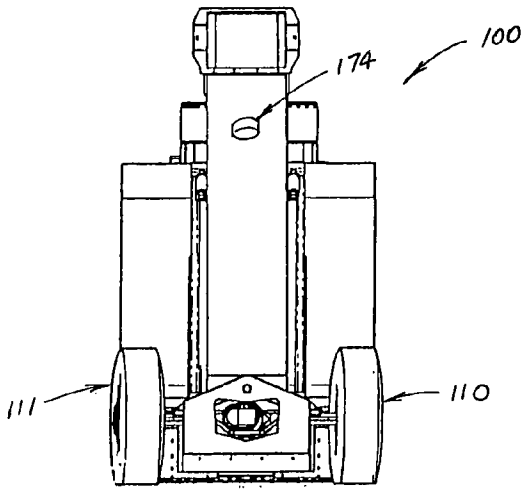
FIG. 8 is a rear view of the embodiment of FIGS. 4–7 showing the paver-loading conveyor in an elevated position.
Figure 7:
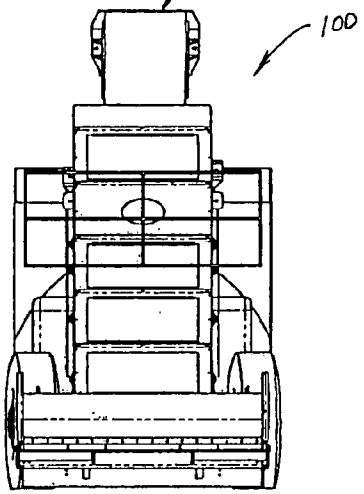
FIG. 7 is a front view of the embodiment of FIGS. 4–6 showing the paver-loading conveyor in an elevated position.
Figure 6:
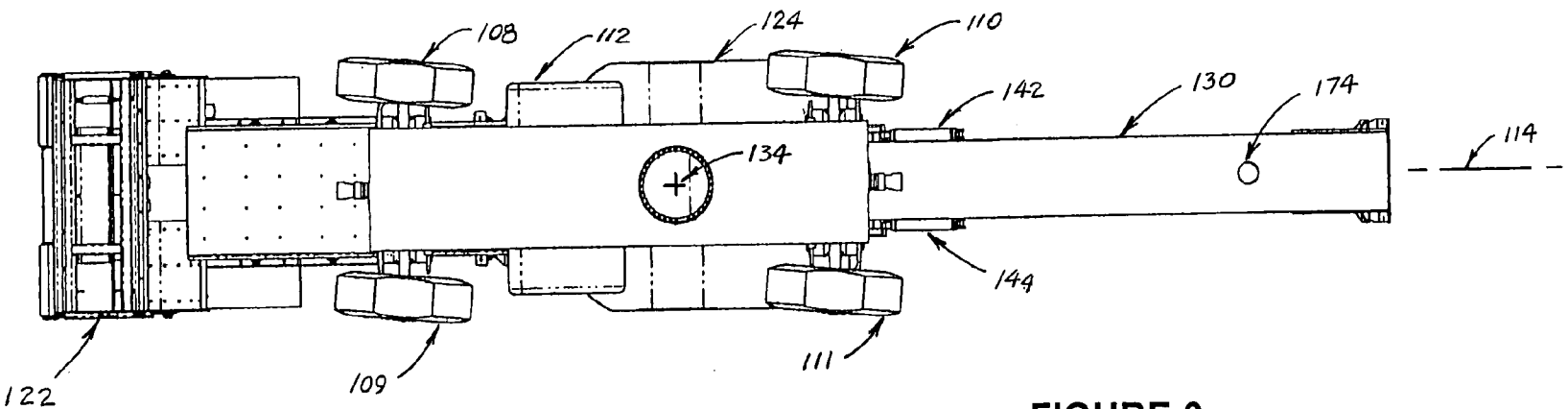
FIG. 6 is a bottom view of the embodiment of FIGS. 4–5 showing the paver-loading conveyor in an elevated position.
Figure 9:
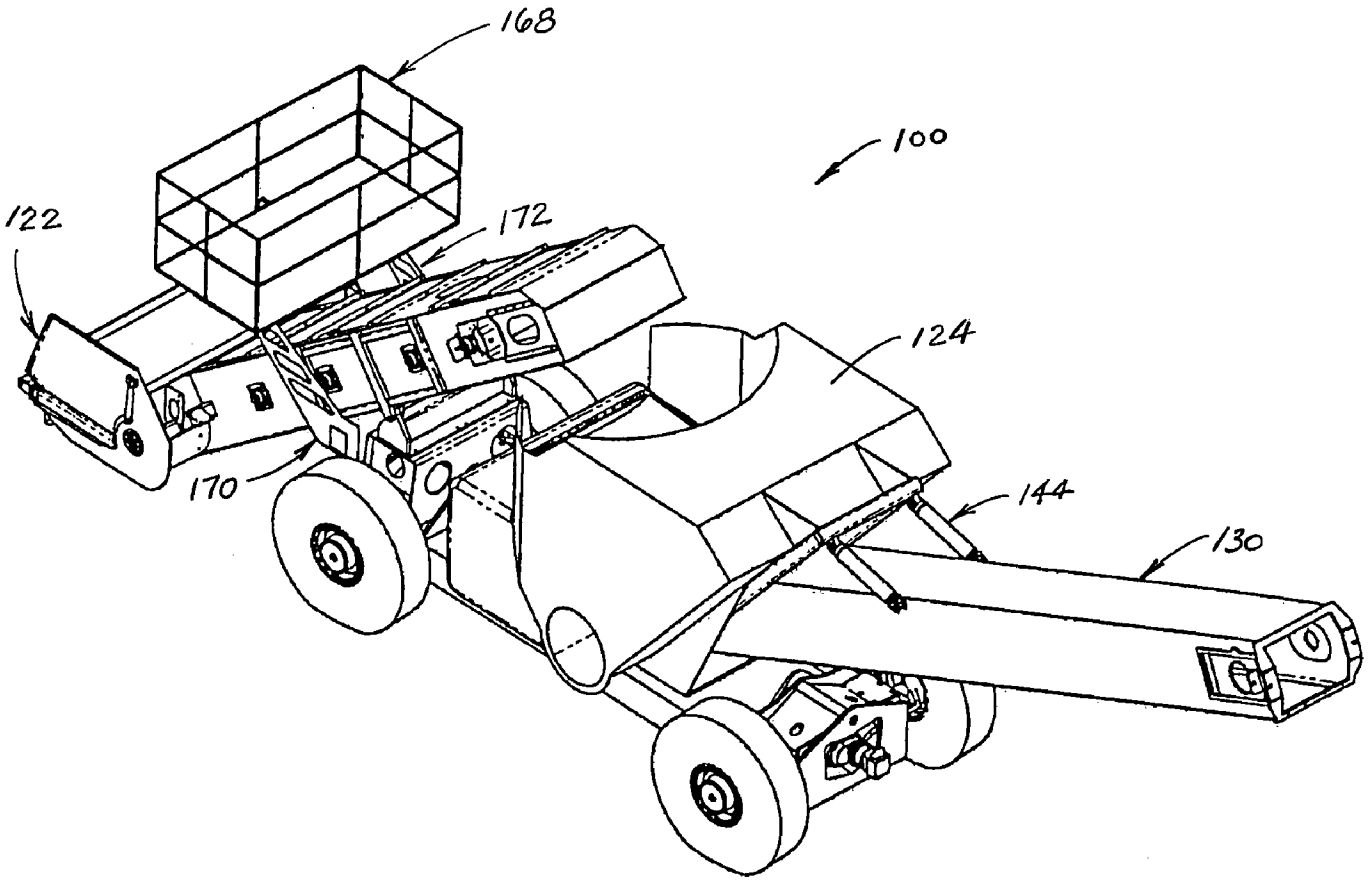
FIG. 9 is a rear perspective view of the embodiment of FIGS. 4–8 showing the paver-loading conveyor in an elevated position.
Figure 11:
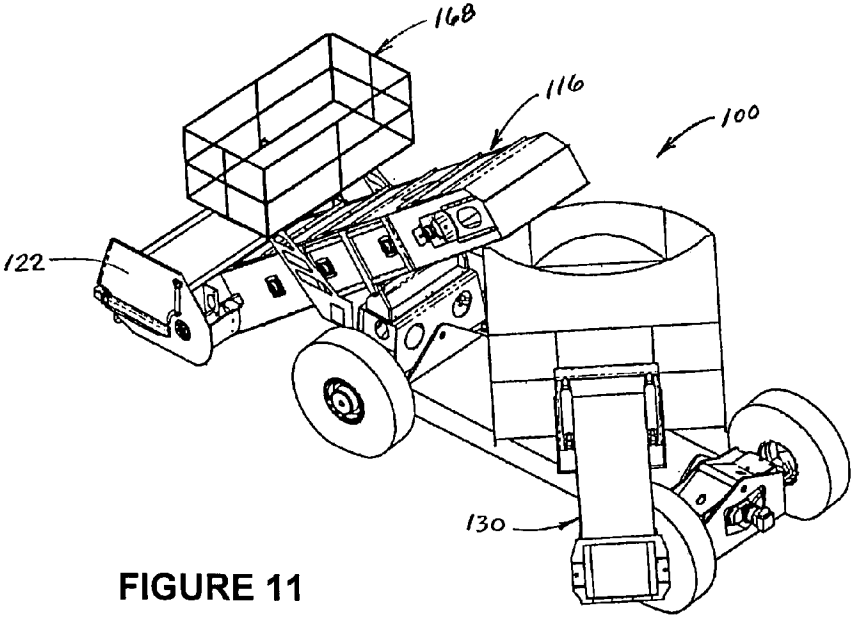
FIG. 11 is a rear perspective view of the embodiment of FIGS. 4–10 showing the turret in a rotated position.
Figure 10:
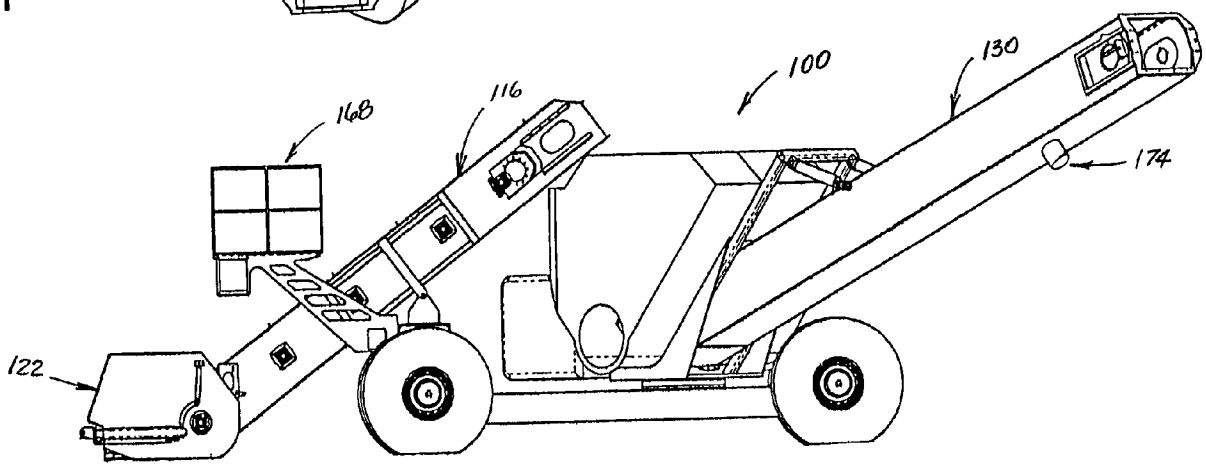
FIG. 10 is a side view of the embodiment of FIGS. 4–9 showing the turret in a rotated position.
Figure 12:
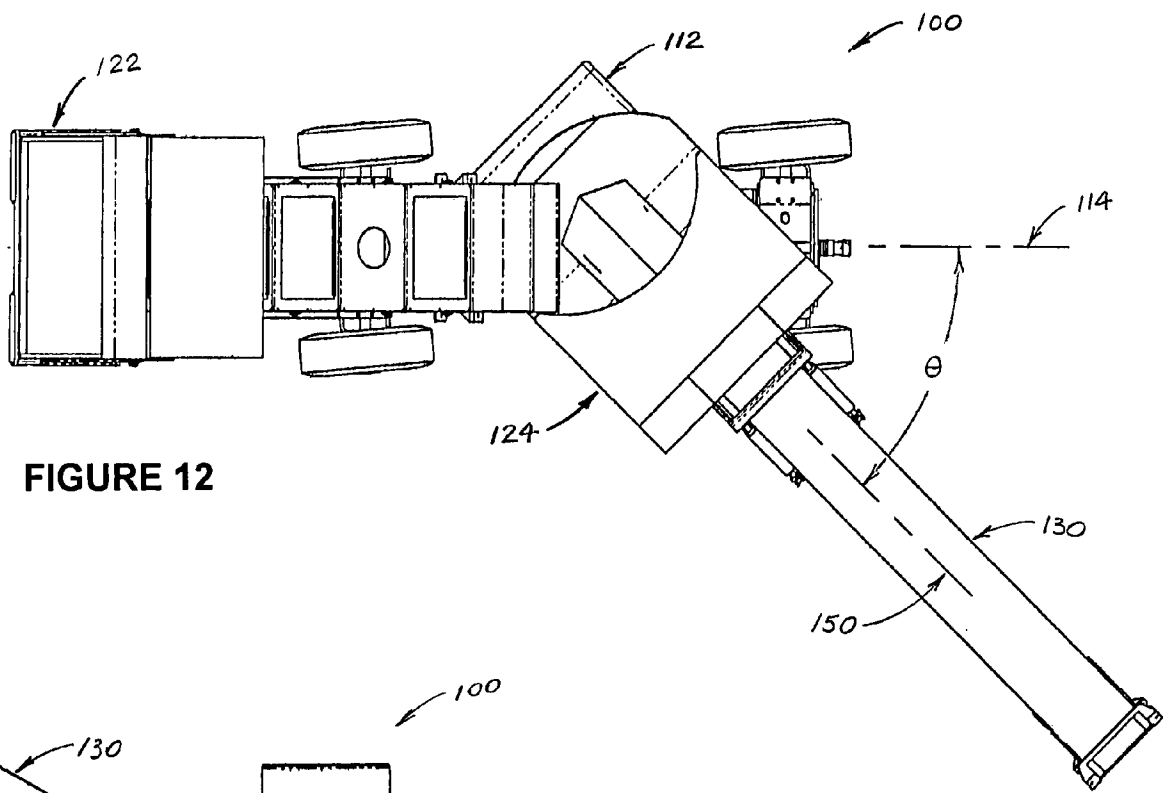
FIG. 12 is a top view of the embodiment of FIGS. 4–11 showing the turret in a rotated position.
Figure 13:
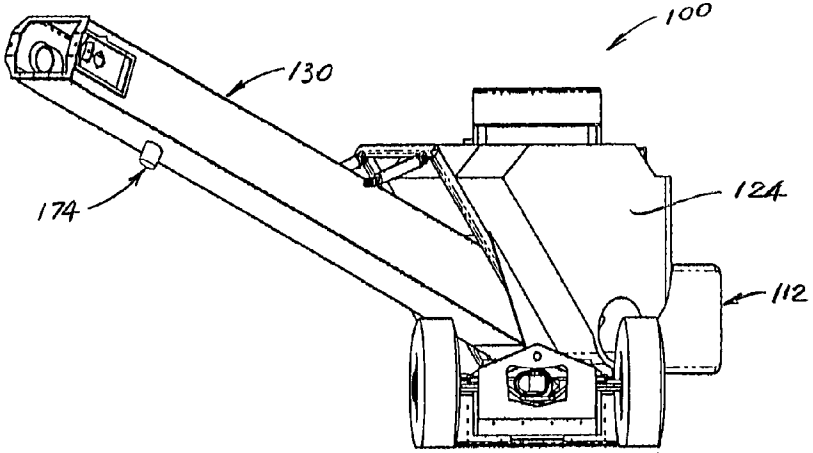
FIG. 13 is a rear view of the embodiment of FIGS. 4–12 showing the turret in a rotated position.
Figure 15:
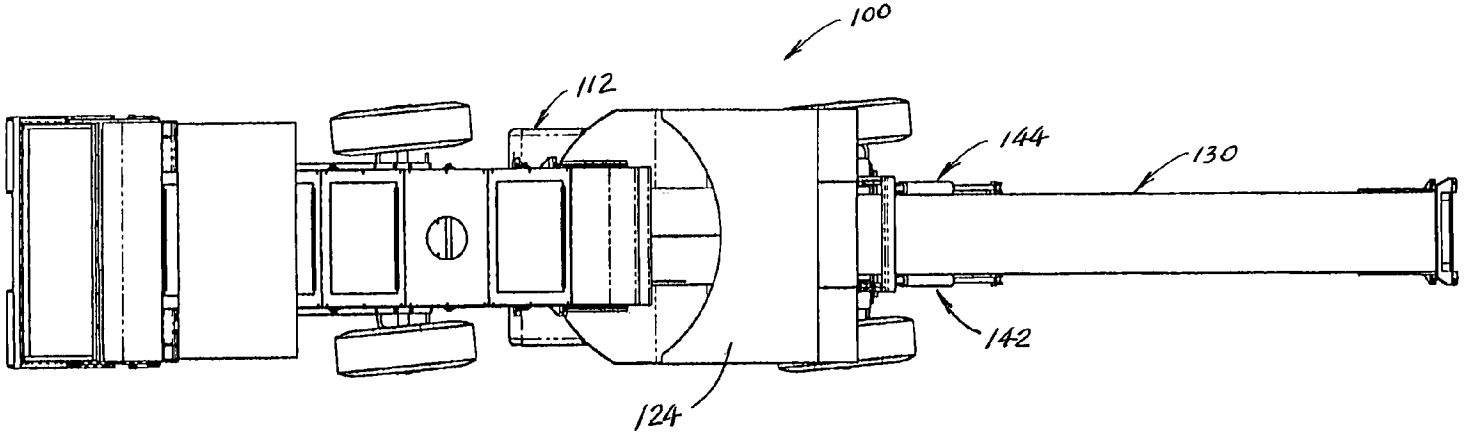
FIG. 15 is a top view of the embodiment of FIGS. 4–14 showing the paver-loading conveyor in a lowered position and the truck-unloading conveyor in a raised or travel position.
Figure 14:
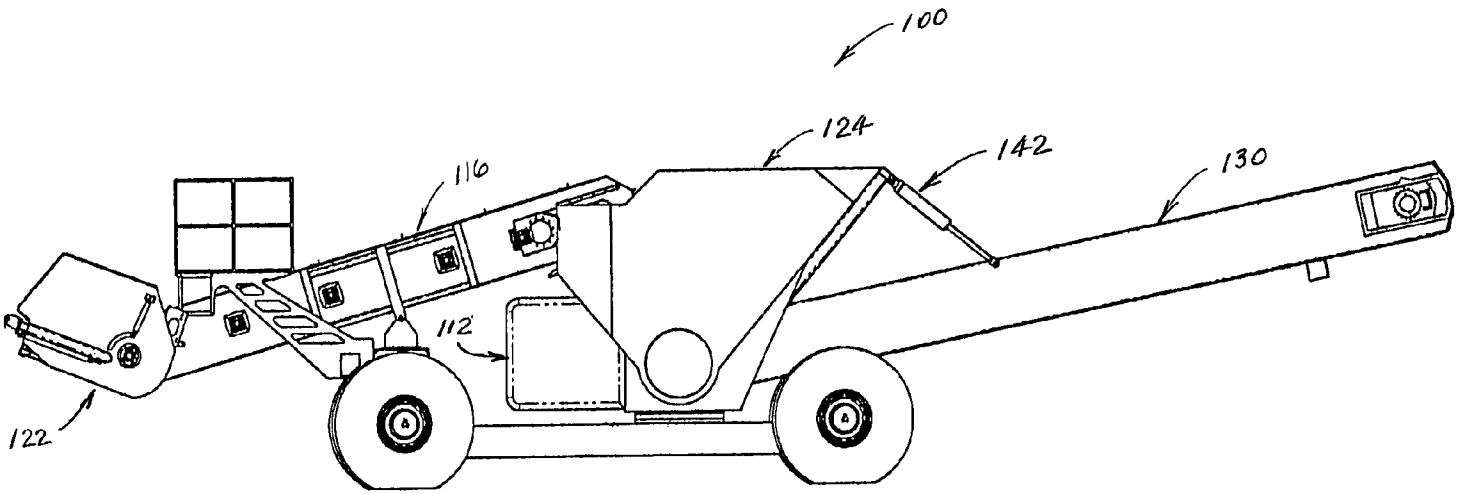
FIG. 14 is a side view of the embodiment of FIGS. 4–13 showing the paver-loading conveyor in a lowered position and the truck-unloading conveyor in a raised or travel position.
Figure 17:
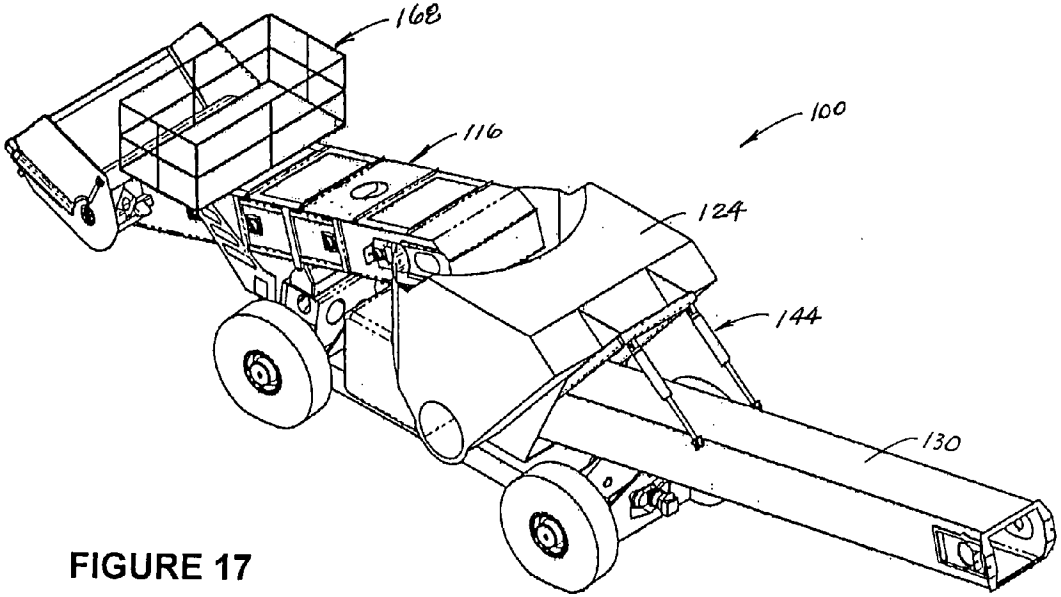
FIG. 17 is a rear perspective view of the embodiment of FIGS. 4–16 showing the paver-loading conveyor in a lowered position and the truck-unloading conveyor in a raised or travel position.
Figure 16:
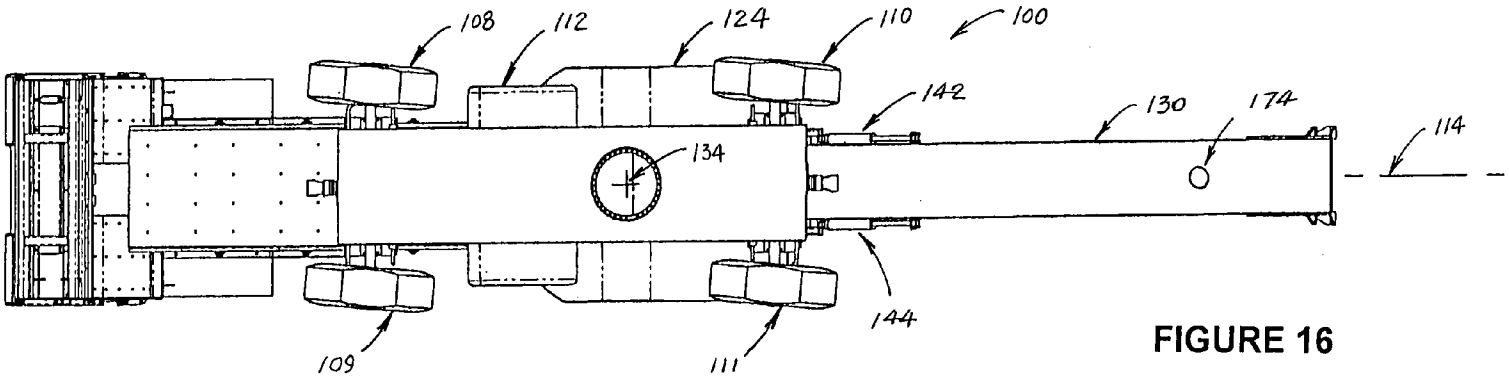
FIG. 16 is a bottom view of the embodiment of FIGS. 4–15 showing the paver-loading conveyor in a lowered position and the truck-unloading conveyor in a raised or travel position.

Surge bin 124 and paver-loading conveyor 130 are mounted on turret 132 which is rotatably mounted on frame 102 so as to rotate about turret axis 134. In the embodiment of the invention illustrated in FIGS. 4–17, surge bin 124, engine compartment 112 and paver-loading conveyor 130 are all mounted on rotatable turret 132 (best shown in FIG. 4). In this embodiment of the invention, turret 132 is rotated to the left and right of frame axis 114 by the action of a pair of actuators (one of which, hydraulic cylinder 136, is shown in FIG. 4) which are connected between rear side 128 of surge bin 124 and a bracket (not shown) on the frame adjacent to the rear wheel set. Preferably, by coordinating the extension and retraction of these linear actuators (including cylinder 136), the turret may be rotated from an angle θ of about 45° to the left of frame axis 114 (best shown in FIG. 12) through an angle of about 45° to the right of frame axis 114. Rotation of turret 132 to the left side of axis 114 is illustrated in FIGS. 10–13.

Extending from the discharge opening at the bottom of rear side 128 of preferred surge bin 124 is paver-loading conveyor 130. Paver-loading conveyor 130 has an inlet end 138 (shown in FIG. 18) and an outlet end 140. Paver-loading conveyor 130 is mounted on turret 132, either directly or indirectly (by attachment to the surge bin). Paver-loading conveyor 130 is preferably of the drag-slat type, and is adapted to transport asphalt from inlet end 138 in surge bin 124 to outlet end 140 and into the hopper of a paving machine (such as hopper 14 of paving machine 12, shown in FIG. 1). Preferably, the inlet end of paver-loading conveyor 130 is pivotally attached to the turret (or to the surge bin), so that paver-loading conveyor 130 may be pivoted between a lowered position that is preferably about 12° above the horizontal (shown in FIGS. 14–17) and a raised position that is about 25° above the horizontal. It is also preferred that the paver-loading conveyor be pivoted between the lowered position and the raised position by a pair of actuators such as hydraulic cylinders 142 and 144 that are connected between rear side 128 of the surge bin and the paver-loading conveyor. FIGS. 14–17 also show truck-unloading conveyor 116 in a raised travel position, which is accomplished by means known to those having ordinary skill in the art to which the invention relates.

Figure 5:
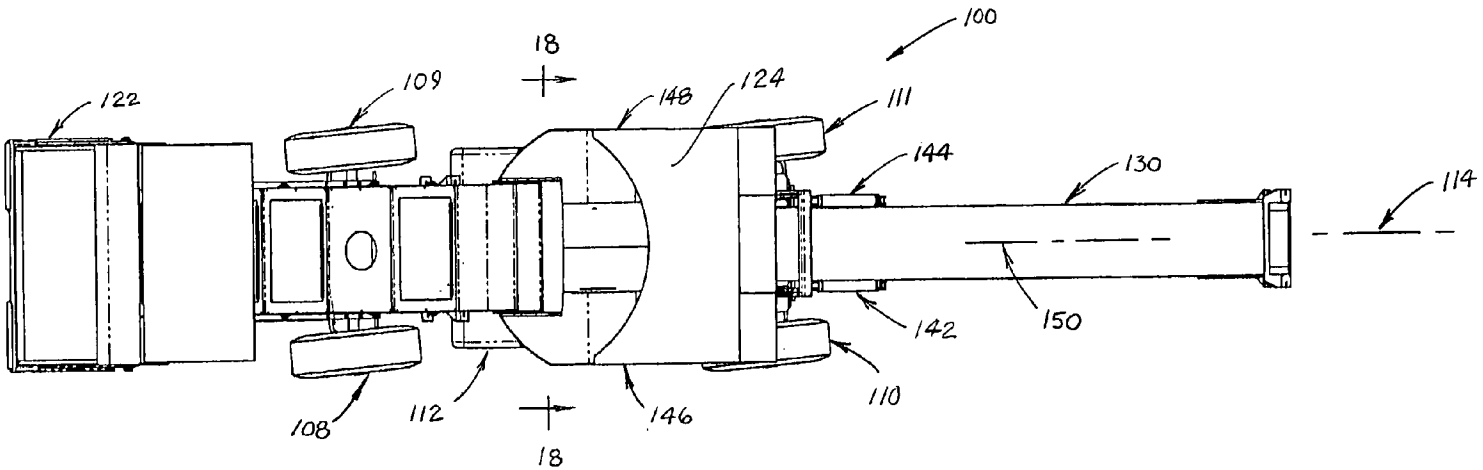
FIG. 5 is a top view of the embodiment of FIG. 4 showing the paver-loading conveyor in an elevated position.

As shown in FIGS. 5 and 18, a transverse mixing auger is mounted in the lower portion of preferred surge bin 124 between left outside sidewall 146 and right outside sidewall 148. Equidistant between the left outside sidewall and the right outside sidewall is a centerline (not shown, but which is coplanar with paver-loader conveyor axis 150, shown in FIG. 5). The transverse mixing auger includes a plurality of auger blades mounted on shaft 152 for rotation about transverse axis 154. The transverse mixing auger includes left-side set 156 of auger blades, which is located between the surge bin centerline and left outside sidewall 146, and right-side set 158 of auger blades, which is located between the centerline and right outside sidewall 148. Preferably, as shown in FIG. 18, inlet end 138 of paver-loading conveyor 130 is located between the left-side set of auger blades and the right-side set of auger blades.

It is also preferred that auger blade 160 in left-side set 156 that is located nearest the centerline has a diameter greater than that of auger blade 162 in the left-side set that is nearest left outside sidewall 146. Preferably, as shown in FIG. 18, except for auger blade 162 that is located adjacent to left outside sidewall 146, the diameter of each auger blade in left-side set 156 is greater than the diameter of the adjacent auger blade in the left-side set that is located nearer to left outside sidewall 146. It is also preferred that auger blade 164 in right-side set 158 that is located nearest the centerline has a diameter greater than that of auger blade 166 in the right-side set that is nearest right outside sidewall 148. Furthermore, it is also preferred that except for auger blade 166 that is located adjacent to right outside sidewall 148, the diameter of each auger blade in right-side set 158 is greater than the diameter of the adjacent auger blade in the right-side set that is located nearer to right outside sidewall 148. By providing the preferred transverse mixing auger with auger blades having a varied diameter across the surge bin, segregation and separation of aggregate material in the asphalt mix is minimized.

FIG. 19 illustrates an alternative transverse mixing auger that is mounted in the lower portion of surge bin 224, which is interchangeable with surge bin 124 on vehicle 100. This alternative mixing auger is mounted between left outside sidewall 246 and right outside sidewall 248 of surge bin 224. Equidistant between the left outside sidewall and the right outside sidewall is a centerline (not shown). This mixing auger includes a plurality of auger blades mounted on a shaft for rotation about transverse axis 254. This alternative mixing auger includes left-side set 256 of auger blades, which is located between the surge bin centerline and left outside sidewall 246, and right-side set 258 of auger blades, which is located between the centerline and right outside sidewall 248. Preferably, as shown in FIG. 19, the inlet end of paver-loading conveyor 230 (which is essentially identical to conveyor 130) is located between the left-side set of auger blades and the right-side set of auger blades. As can be seen by comparing FIG. 19 and FIG. 18, the auger blades of the alternative mixing auger having a varied diameter across the surge bin in the same way that the diameter of the auger blades varies across surge bin 124 of FIG. 18. However, it is also preferred in this alternative embodiment that the pitch (indicated at 260) between the auger blade in the left-side set that is located nearest the centerline and the adjacent auger blade in the left-side set is greater than the pitch (indicated at 262) between the auger blade in the left-side set that is located nearest the left outside sidewall and the adjacent auger blade in the left-side set. In fact, it is especially preferred that except for the auger blade located adjacent to the left outside sidewall, the pitch between each auger blade in the left-side set and the adjacent auger blade that is nearer the centerline is greater than the pitch between such auger blade and the adjacent auger blade nearer the left outside sidewall. Similarly, it is preferred that the pitch between the auger blade in the right-side set that is located nearest the centerline and the adjacent auger blade in the right-side set is greater than the pitch between the auger blade in the right-side set that is located nearest the right outside sidewall and the adjacent auger blade in the right-side set. It is also preferred that except for the auger blade located adjacent to the right outside sidewall, the pitch between each auger blade in the right-side set and the adjacent auger blade that is nearer the centerline is greater than the pitch between such auger blade and the adjacent auger blade nearer the right outside sidewall. This alternative mixing auger has auger blades with varied diameter and pitch across the surge bin, which would also serve to minimize segregation and separation of aggregate materials of various particle sizes.

Referring again to FIGS. 4–17, preferred vehicle 100 also includes a forward-mounted operator station, (shown schematically at 168) which is mounted above truck-unloading conveyor 116 on supports 170 and 172 that are attached to frame 102. Preferably, operator station 168 is located in front of the front wheel set. Since the operator's station of this embodiment of the invention is located on the front portion of the vehicle, it is also preferred that a rear-view camera 174 be provided which is mounted on the underside of paver-loading conveyor 130, and that the operator's station include a monitor (not shown) for displaying an image from camera 174.

Preferably, steering of the front wheel set is operated by a conventional steering wheel (not shown) and steering for the rear wheel set is operated by a joystick that is located on a control console (not shown) in operator's station 168. The preferred joystick for steering the rear wheel set has positions for steering left, steering right and centering the rear wheel set (so that the wheels of this wheel set are parallel to frame axis 114). By turning the steering wheel to the left or right and leaving the joystick in the neutral (or centered) position, the vehicle can be maneuvered like a conventional automobile. By turning the steering wheel to the left and shifting the joystick to the right (or by turning the steering wheel to the right and shifting the joystick to the left), the vehicle will steer in the direction the steering wheel is turned but with a smaller turning radius than if the rear wheels remain centered. By turning the steering wheel to the left and shifting the joystick to the left (or by turning the steering wheel to the right and shifting the joystick to the right), the vehicle will move in a "crab-wise" manner in a direction that is oblique to the frame axis.

Figure 20:
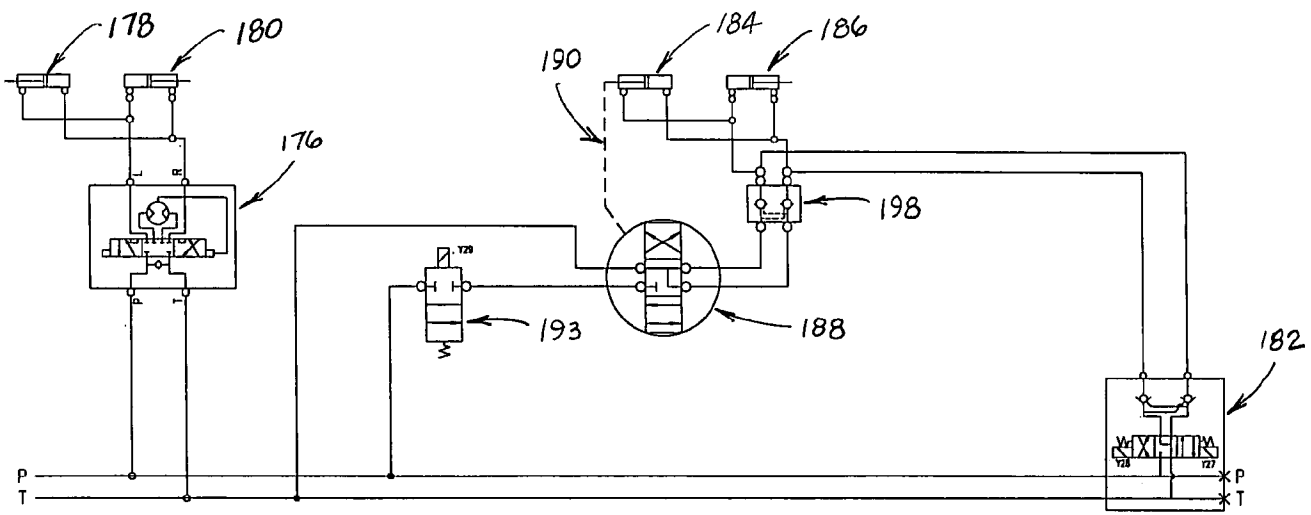
FIG. 20 is a schematic illustration of the hydraulic circuit for the steering system of the embodiment of FIGS. 4–18.
Figure 21:
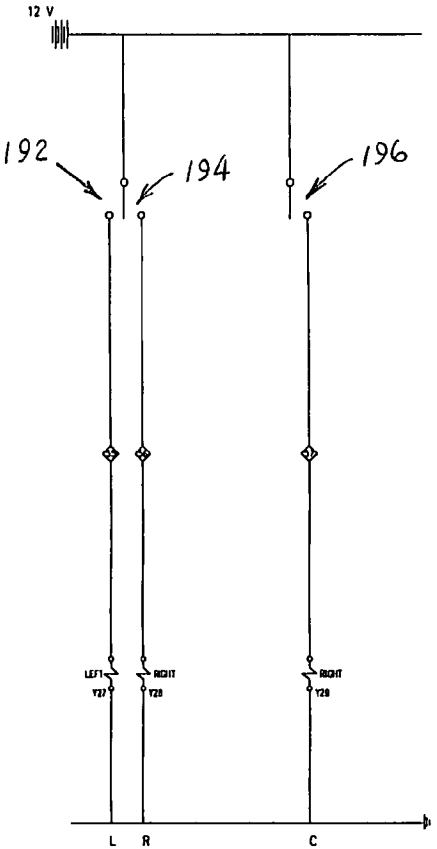
FIG. 21 is a schematic illustration of the electrical switching for the rear steering components of the embodiment of FIGS. 4–18 and 20.
Figure 22:
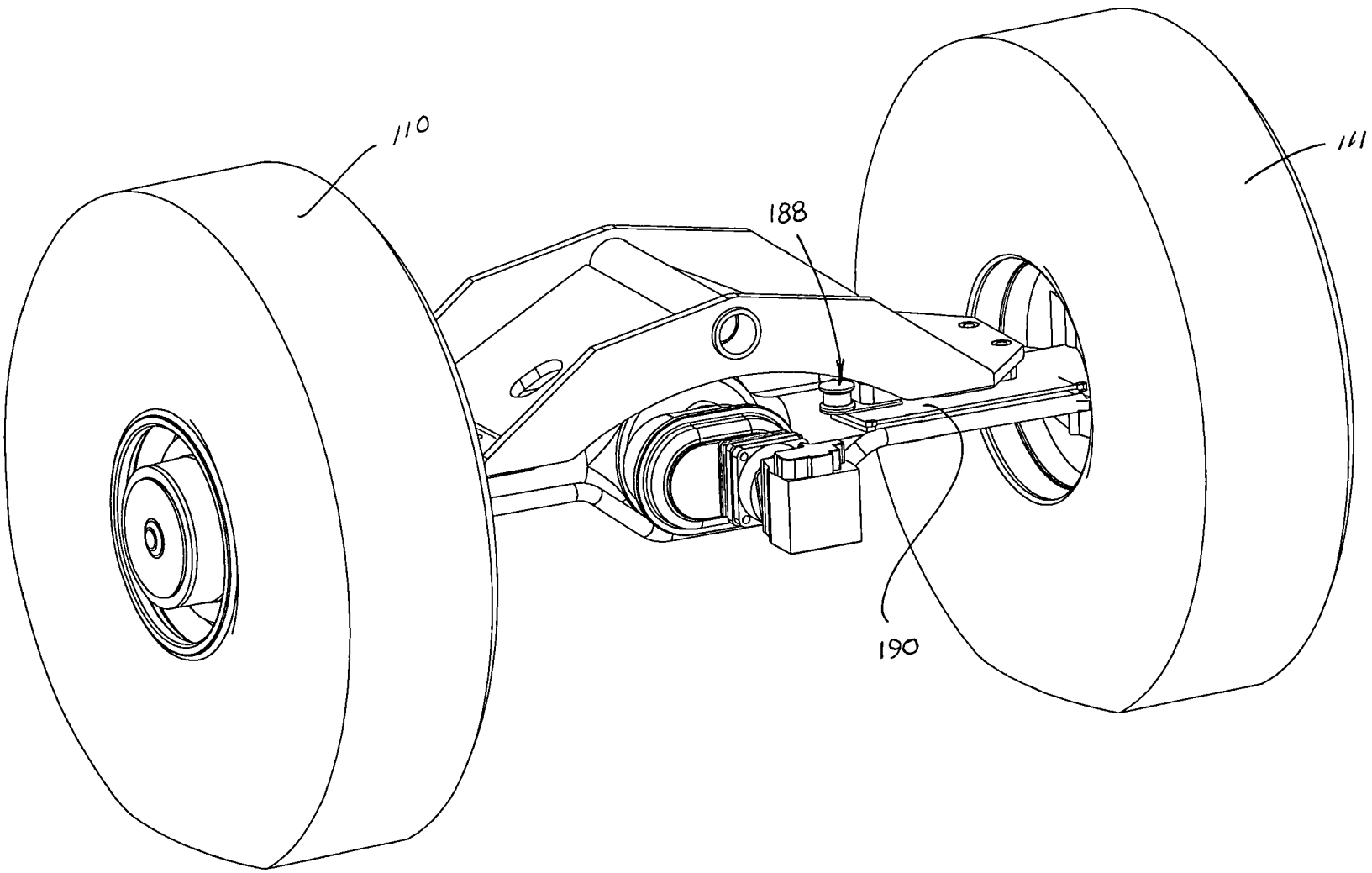
FIG. 22 is a perspective view of a portion of the components of the rear steering subsystem of the embodiment of FIGS. 4–18 and 20–21.

Referring now to FIG. 20, the hydraulic circuit for the preferred steering system of vehicle 100 is illustrated. As shown therein, this circuit includes a conventional steering unit 176 which controls the flow of fluid to left front steering cylinder 178 and right front steering cylinder 180. A conventional hydraulic solenoid valve 182 controls the flow of fluid to left rear steering cylinder 184 and right rear steering cylinder 186. A position sensor valve 188 (also shown in FIG. 22) such as is sold under the trademark MICRO-TORK® by Microtork-Rotovalve of Warren, N.J., is linked by linkage 190 to the steering yoke connection point for the rear wheel set in order to sense the angular position of the rear wheel set with respect to the frame. Referring now to FIGS. 20 and 21, it can be seen that energizing switch 192 (by shifting the rear steering joystick to the left) allows four-way, three-position directional solenoid valve 182 to direct flow to the piston side of cylinder 184 and to the rod side of cylinder 186 to steer the rear wheel set to the left, while energizing switch 194 (by shifting the rear steering joystick to the right) allows four-way, three-position directional solenoid valve 182 to direct flow to the piston side of cylinder 186 and the rod side of cylinder 184 to steer the rear wheel set to the right. When rear steering centering switch 196, which is preferably operated by a button on the joystick, is energized, two-way poppet solenoid valve 193 directs flow through position sensor valve 188 to position hold valve 198, which causes left rear steering cylinder 184 and right rear steering cylinder 186 to center the rear wheel set so that the rear wheels are aligned with the frame axis. If the joystick is shifted either to the left or the right without engaging rear steering centering switch 196, position hold valve 198 will maintain the left-steered or right-steered position of the rear wheel set until the joystick is shifted in the other direction or centering switch 196 is energized.

FIGS. 23–26 illustrate a second embodiment of the invention. As shown therein, self-propelled material transport vehicle 200 includes frame 202 having a front end at 204 and a rear end at 206. Vehicle 200 includes a vehicle drive system which is operatively attached to frame 202 and is adapted to drive the vehicle along a roadway surface. This vehicle drive system includes a front wheel set comprised of left front wheel 208 and right front wheel 209 and a rear wheel set comprised of left rear wheel 210 and right rear wheel 211. Each wheel of a wheel set is connected to an axle that is driven by a hydraulic motor (not shown) which is supplied with fluid under pressure by one or more hydraulic pumps (also not shown). This hydrostatic drive system is similar to the hydrostatic drive systems of vehicles 10, 40 and 100. An engine (located in compartment 212) provides the motive force for the hydraulic pumps. In this embodiment of the invention, it is preferred that the same steering modes be provided as are described herein in connection with the description of vehicle 100.

The preferred embodiment of vehicle 200 also includes truck-unloading conveyor 216 having inlet end 218 and outlet end 220. Truck receiving hopper 222 is mounted on the inlet end of truck-unloading conveyor for receiving asphalt from a delivery truck such as truck 16. Hopper 222 is generally of the same width as truck bed 17 and is adjustable in length so that the contents of a delivery truck can be easily and quickly emptied into the hopper. Conveyor 216 is preferably of the drag-slat type and is adapted to quickly convey an entire truckload of asphalt from the inlet end to the outlet end and into surge bin 223. Surge bin 223 is adapted to contain a quantity of asphalt and has a front side 226 and a rear side 228. Rear side 228 of surge bin 223 has a discharge opening to receive the inlet end of paver-loading conveyor 229. Surge bin 223 and paver-loading conveyor 229 are mounted on turret 232 which is rotatably mounted on frame 202 so as to rotate about turret axis 234. In the embodiment of the invention illustrated in FIGS. 23–26, engine compartment 212 is mounted on frame 202, instead of on the turret.

A transverse mixing auger (not shown, but which may be similar to those illustrated in FIGS. 18 and 19 in connection with the description of vehicle 100) is mounted in the lower portion of preferred surge bin 223 between left outside sidewall 245 and right outside sidewall 247. Equidistant between the left outside sidewall and the right outside sidewall is a centerline (not shown, but which is coplanar with paver-loader conveyor axis 250, shown in FIG. 26). The transverse mixing auger includes a plurality of auger blades mounted on a shaft (not shown) for rotation about transverse axis 254. The transverse mixing auger may include a left-side set of auger blades (not shown), which is located between the surge bin centerline and left outside sidewall 245, and a right-side set of auger blades (also not shown), which is located between the centerline and right outside sidewall 247.

Extending from the discharge opening at the bottom of rear side 228 of preferred surge bin 223 is paver-loading conveyor 229. Paver-loading conveyor 229 has an inlet end (similar to inlet end 138 of conveyor 130 of vehicle 100), and an outlet end 240. The paver-loading conveyor is mounted on the turret, either directly or indirectly (by being attached to the surge bin).

Preferably, the inlet end of paver-loading conveyor 229 is pivotally attached to the turret (or to the surge bin) so as to be located between the left-side set of auger blades and the right-side set of auger blades (similar to the location of inlet end 138 of paver-loading conveyor 130 which is illustrated in FIG. 18). Paver-loading conveyor 229 is preferably of the drag-slat type, and is adapted to transport asphalt from its inlet end in surge bin 223 to outlet end 240 and into the hopper of a paving machine (such as hopper 14 of paving machine 12, shown in FIG. 1). Preferably, paver-loading conveyor 229 is adapted to be pivoted between a lowered position that is preferably about 12° above the horizontal (not shown, but similar to the lowered position of paver-loading conveyor 130 of vehicle that is shown in FIGS. 14–17) and a raised position that is about 25° above the horizontal. It is also preferred that the paver-loader conveyor be pivoted between the lowered position and the raised position by an actuator comprising hydraulic cylinder 242 that is connected between rear side 228 of the surge bin and the paver-loader conveyor.

Figure 23:
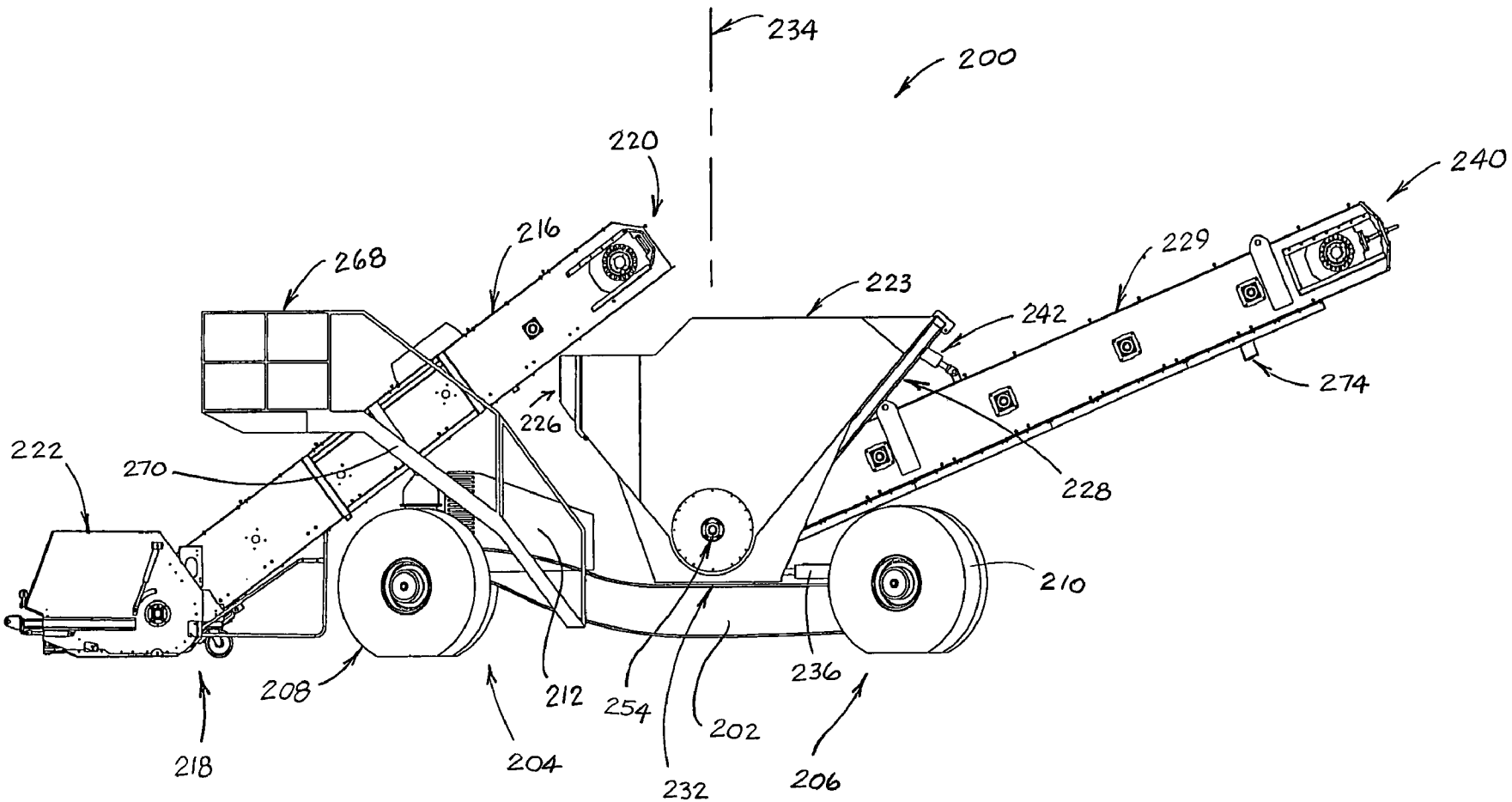
FIG. 23 is a side view of a second embodiment of the invention showing the paver-loading conveyor in an elevated position.
Figure 24:
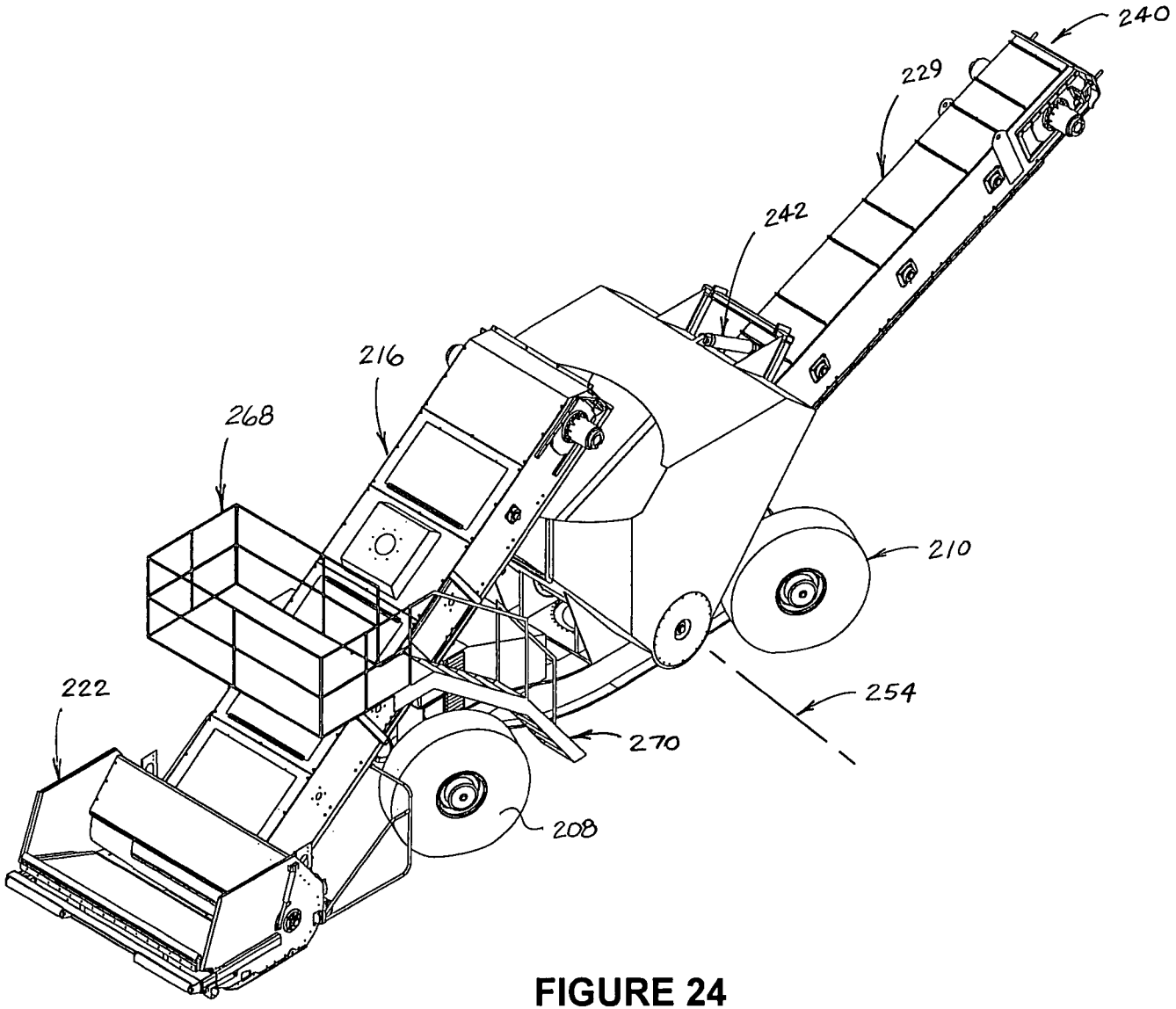
FIG. 24 is a front perspective view of the embodiment of FIG. 23 showing the paver-loading conveyor in an elevated position.
Figure 25:
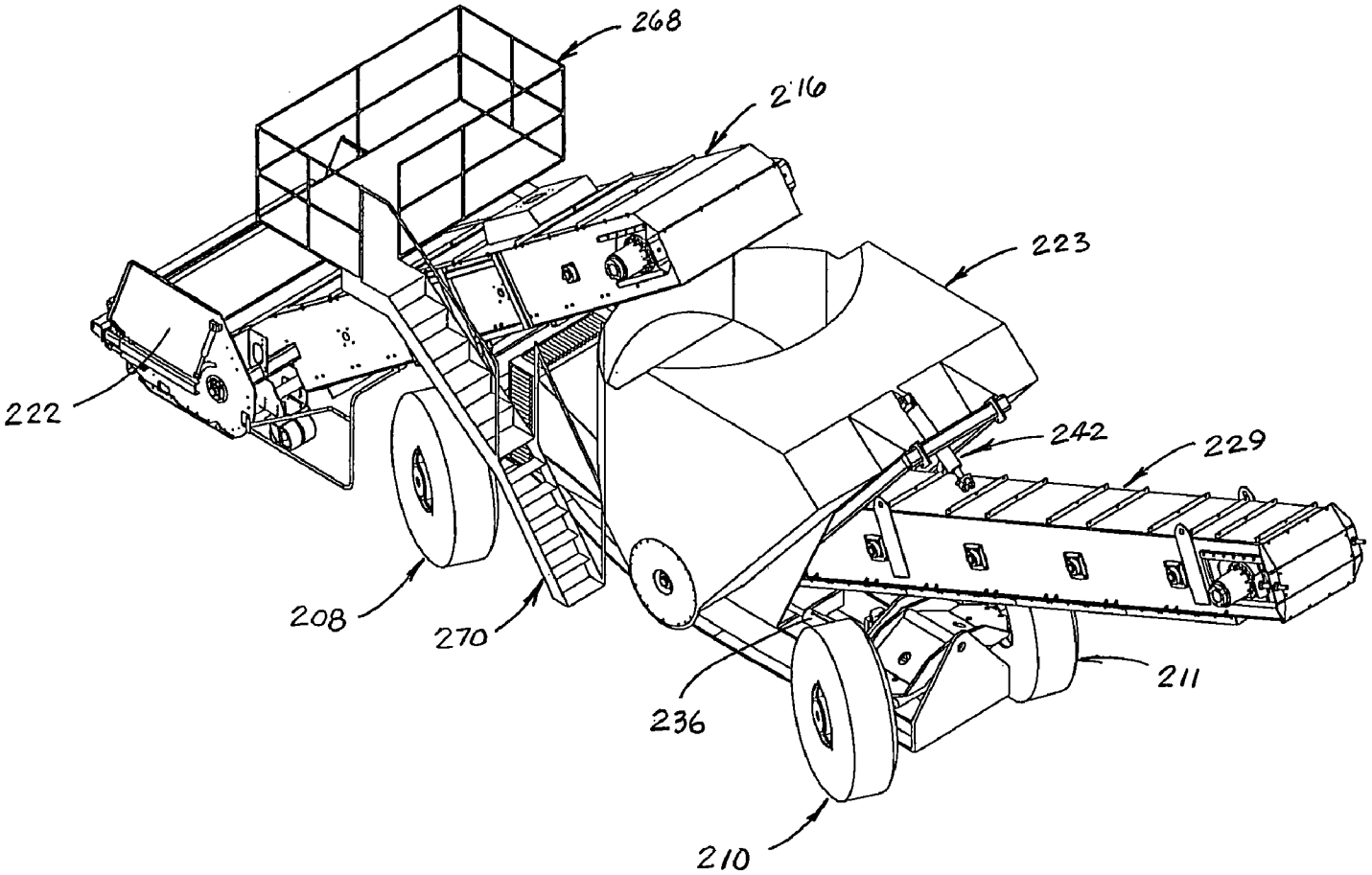
FIG. 25 is a rear perspective view of the embodiment of FIGS. 23–24 showing the paver-loading conveyor in an elevated position.
Figure 26:
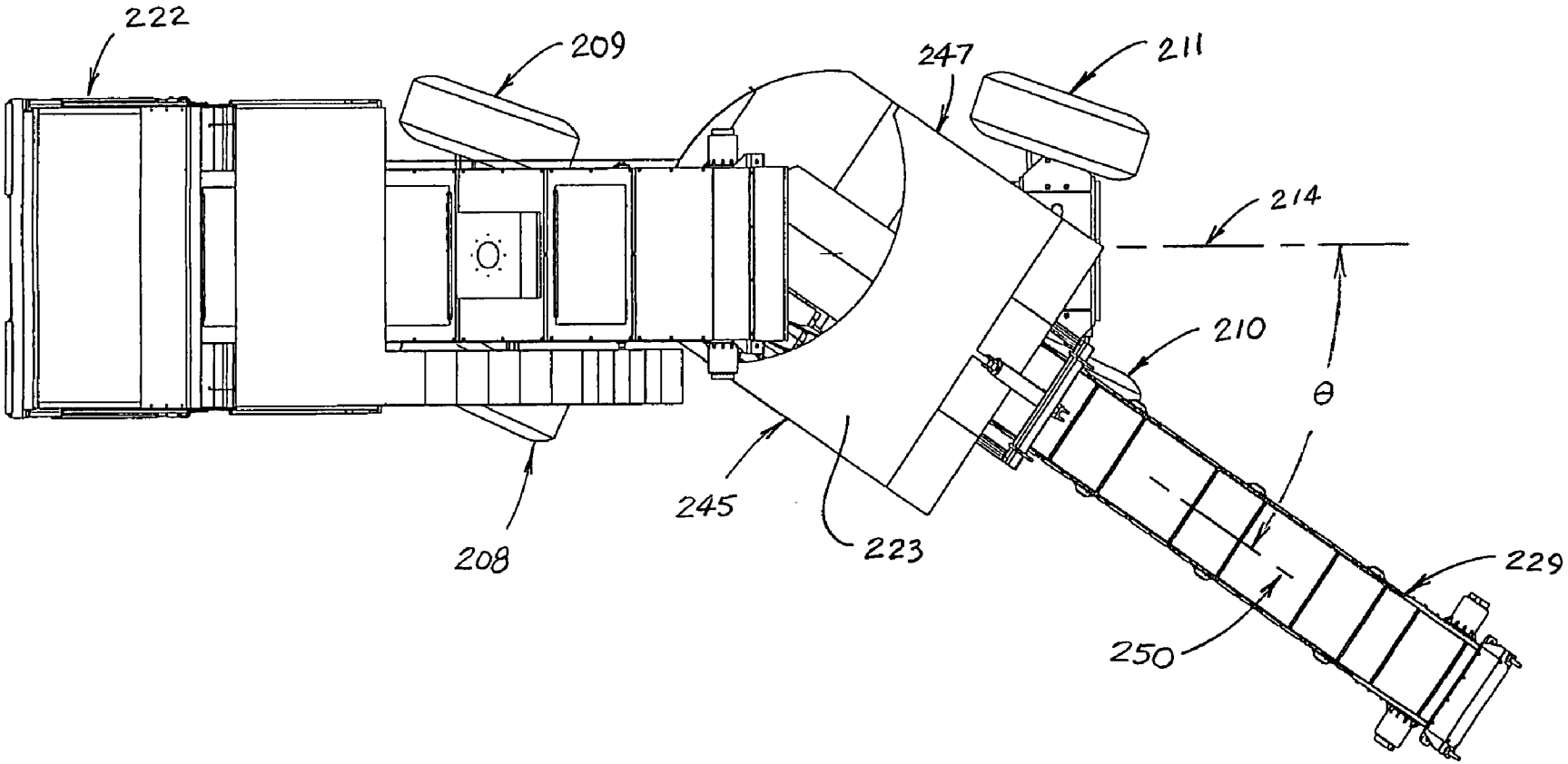
FIG. 26 is a top view of the embodiment of FIGS. 23–25 showing the turret in a rotated position.

In this embodiment of the invention, turret 232 is rotated to the left and right of frame axis 214 by the action of a pair of actuators (one of which, hydraulic cylinder 236, is shown in FIGS. 23 and 25) which are connected between rear side 228 of surge bin 223 and a bracket (not shown) on the frame adjacent to the rear wheel set. Preferably, by coordinating the extension and retraction of these linear actuators (including cylinder 236), the turret may be rotated from an angle ↓ of about 45° to the left of frame axis 214 (shown in FIG. 26) through an angle of about 45° to the right of frame axis 214.

Vehicle 200 also includes a forward-mounted operator station, (shown schematically at 268) which is mounted above truck-unloading conveyor 216 on supports (including stairway support 270) that are attached to frame 202. Preferably, operator station 268 is located in front of the front wheel set. Since the operator's station of this embodiment of the invention is located on the front portion of the vehicle, it is also preferred that a rear-view camera 274 be provided which is mounted on the underside of paver-loading conveyor 229, and that the operator's station include a monitor (not shown) for displaying an image from camera 274.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A material transfer vehicle for transporting asphalt from a delivery truck to a paving machine, which vehicle comprises:

(a) a frame having a first end and a second end;

(b) a vehicle drive system which is operatively attached to the frame and adapted to drive the vehicle;

(c) a turret that is rotatably mounted on the frame;

(d) a surge bin:

(i) that is mounted on the turret;

(ii) that has a front side;

(iii) that has a rear side with a discharge opening therein;

(iv) that is adapted to contain a quantity of asphalt;

(e) a truck-unloading conveyor:

(i) that is mounted on the frame;

(ii) that has an inlet end;

(iii) that has an outlet end which is adjacent to the front side of the surge bin;

(iv) that is adapted to move asphalt from the inlet end to the outlet end;

(g) a paver-loading conveyor:

(i) that is mounted on the turret;

(ii) that has an inlet end extending into the discharge opening on the rear side of the surge bin;

(iii) that has a outlet end;

(iv) that is adapted to move asphalt from the inlet end to the outlet end.

2. The material transfer vehicle of claim 1 which includes a truck receiving hopper that is mounted on the inlet end of the truck-unloading conveyor.

3. The material transfer vehicle of claim 1 which includes an operator's station that is mounted above the truck-unloading conveyor.

4. The material transfer vehicle of claim 1 wherein the surge bin includes:

(a) a left outside sidewall, a right outside sidewall, and a centerline that is equidistant from the left outside sidewall and the right outside sidewall;

(b) a transverse mixing auger that is mounted in the lower portion of the surge bin between the left outside sidewall and the right outside sidewall, said transverse mixing auger comprising:

(i) a shaft mounted for rotation about an axis of rotation within the surge bin;

(ii) a plurality of auger blades mounted on the shaft, including a left-side set of auger blades located between the centerline and the left outside wall, and a right-side set of auger blades located between the centerline and the right outside sidewall, wherein the auger blade in the left-side set that is located nearest the centerline has a diameter greater than that of the auger blade in the left-side set that is nearest the left outside sidewall, and the auger blade in the right-side set that is located nearest the centerline has a diameter greater than that of the auger blade in the right-side set that is nearest the right outside sidewall.

5. The material transfer vehicle of claim 4 wherein the inlet end of the paver-loading conveyor is located between the left-side set of auger blades and the right-side set of auger blades.

6. The material transfer vehicle of claim 4 wherein:

(a) except for the auger blade located adjacent to the left outside sidewall, the diameter of each auger blade in the left-side set is greater than the diameter of the adjacent auger blade in the left-side set that is located nearer to the left outside sidewall;

(b) except for the auger blade located adjacent to the right outside sidewall, the diameter of each auger blade in the right-side set is greater than the diameter of the adjacent auger blade in the right-side set that is located nearer to the right outside sidewall.

7. The material transfer vehicle of claim 4 wherein:

(a) the pitch between the auger blade in the left-side set that is located nearest the centerline and the adjacent auger blade in the left-side set is greater than the pitch between the auger blade in the left-side set that is located nearest the left outside sidewall and the adjacent auger blade in the left-side set;

(b) the pitch between the auger blade in the right-side set that is located nearest the centerline and the adjacent auger blade in the right-side set is greater than the pitch between the auger blade in the right-side set that is located nearest the right outside sidewall and the adjacent auger blade in the right-side set.

8. The material transfer vehicle of claim 7 wherein:

(a) except for the auger blade located adjacent to the left outside sidewall, the pitch between each auger blade in the left-side set and the adjacent auger blade that is nearer the centerline is greater than the pitch between such auger blade and the adjacent auger blade nearer the left outside sidewall;

(b) except for the auger blade located adjacent to the right outside sidewall, the pitch between each auger blade in the right-side set and the adjacent auger blade that is nearer the centerline is greater than the pitch between such auger blade and the adjacent auger blade nearer the right outside sidewall.

9. The material transfer vehicle of claim 1:

(a) wherein the paver-loading conveyor is adapted to be pivoted between a lowered position and a raised position;

(b) which includes means for pivoting the paver-loading conveyor between the lowered position and the raised position.

10. The material transfer vehicle of claim 9 wherein the paver-loading conveyor is adapted to be pivoted between a lowered position and a raised position that is about 25° above the horizontal.

11. The material transfer vehicle of claim 9 wherein the means for pivoting the paver-loading conveyor between the lowered position and the raised position comprises an actuator that is connected between the surge bin and the paver-loading conveyor.

12. The material transfer vehicle of claim 1:

(a) wherein the turret is adapted to be rotated between a left position and a right position;

(b) which includes means for rotating the turret between the left position and the right position.

13. The material transfer vehicle of claim 12 wherein:

(a) the frame includes a longitudinal axis;

(b) the turret is adapted to be rotated between a left position that is about 45° to the left of the longitudinal axis of the frame and a right position that is about 45° to the right of the longitudinal axis of the frame.

14. The material transfer vehicle of claim 12 wherein the means for rotating the turret between the left position and the right position comprises an actuator that is connected between the frame and the surge bin.

15. The material transfer vehicle of claim 1 wherein the vehicle drive system includes:

(a) a front wheel set that is mounted on the front end of the frame;

(b) a rear wheel set that is mounted on the rear end of the frame;

(c) an engine for supplying power to drive the front wheel set and the rear wheel set.

16. The material transfer vehicle of claim 15 which includes:

(a) an operator's station that is located in front of the front wheel set;

(b) a rear-view camera that is mounted on the paver-loading conveyor.

17. The material transfer vehicle of claim 15 wherein the engine is mounted on the turret.

18. The material transfer vehicle of claim 15:

(a) wherein the front wheel set is steerable;

(b) wherein the rear wheel set is steerable;

(c) which includes a steering system by which the front wheel set alone can be steered, or the front wheel set and rear wheel set can be steered simultaneously.

19. The material transfer vehicle of claim 18 wherein the steering system includes an actuator that is operatively attached to the front wheel set and an actuator that is operatively attached to the rear wheel set.

20. The material transfer vehicle of claim 18 wherein the steering system includes means for allowing the rear wheel set to be steerable or centered at the option of the operator.

* * * * *